US010125592B2

(12) United States Patent
Case et al.

(10) Patent No.: US 10,125,592 B2
(45) Date of Patent: Nov. 13, 2018

(54) METHODS AND SYSTEMS FOR TREATMENT OF SUBTERRANEAN FORMATIONS

(71) Applicant: Halliburton Energy Services, Inc., Houston, TX (US)

(72) Inventors: Leonard R. Case, Duncan, OK (US); Jason E. Bryant, Spring, TX (US); Loyd Eddie East, Telephone, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 353 days.

(21) Appl. No.: 14/902,475

(22) PCT Filed: Aug. 8, 2013

(86) PCT No.: PCT/US2013/054089
§ 371 (c)(1),
(2) Date: Dec. 31, 2015

(87) PCT Pub. No.: WO2015/020654
PCT Pub. Date: Feb. 12, 2015

(65) Prior Publication Data

US 2016/0145988 A1 May 26, 2016

(51) Int. Cl.
*E21B 33/068* (2006.01)
*E21B 43/114* (2006.01)
(Continued)

(52) U.S. Cl.
CPC ..... *E21B 43/25* (2013.01); *E21B 21/062* (2013.01); *E21B 33/068* (2013.01); *E21B 41/00* (2013.01); *E21B 43/114* (2013.01); *E21B 43/26* (2013.01)

(58) Field of Classification Search
CPC ..... E21B 21/062; E21B 33/068; E21B 41/00; E21B 43/114; E21B 43/25; E21B 43/26
See application file for complete search history.

(56) References Cited

U.S. PATENT DOCUMENTS 2,888,988 A * 6/1959 Clark ..... E21B 43/26 166/278
3,664,422 A * 5/1972 Bullen ..... E21B 43/26 166/283

(Continued)

FOREIGN PATENT DOCUMENTS

WO 2012/097425 A1 7/2012

OTHER PUBLICATIONS

International Search Report and Written Opinion issued in related PCT Application No. PCT/US2013/054089 dated May 12, 2014, 16 pages.

(Continued)

*Primary Examiner* — Matthew R Buck
(74) *Attorney, Agent, or Firm* — John Wustenberg; Baker Botts L.L.P.

(57) ABSTRACT

Improved methods and systems for treating subterranean formations using a sub-surface mixing system are disclosed. The disclosed system includes a well head and a first flow line that directs a blender fluid from a blender to the well head. A second flow line directs a Liquefied Petroleum Gas stream to the well head. A static mixer is positioned down-hole and is fluidically coupled to the well head. The well head directs the blender fluid to the static mixer through a first flow path and it directs the Liquefied Petroleum Gas stream from the well head to the static mixer through a second flow path. The static mixer then mixes the blender fluid and the Liquefied Petroleum Gas stream.

18 Claims, 3 Drawing Sheets

(51) Int. Cl.

| | |
|---|---|
| ***E21B 43/25*** | (2006.01) |
| ***E21B 43/26*** | (2006.01) |
| ***E21B 21/06*** | (2006.01) |
| ***E21B 41/00*** | (2006.01) |

(56) References Cited

U.S. PATENT DOCUMENTS

| | | | | |
|---|---|---|---|---|
| 3,730,273 | A * | 5/1973 | Wilson | E21B 43/14 166/269 |
| 3,842,910 | A * | 10/1974 | Zingg | E21B 43/26 166/308.1 |
| 6,230,805 | B1 * | 5/2001 | Vercaemer | E21B 19/22 166/300 |
| 6,439,310 | B1 * | 8/2002 | Scott, III | E21B 43/26 166/250.1 |
| 8,104,539 | B2 * | 1/2012 | Stanojcic | E21B 43/267 166/177.5 |
| 8,651,187 | B2 * | 2/2014 | Smith | C09K 8/685 166/279 |
| 2007/0204991 | A1 * | 9/2007 | Loree | C09K 8/64 166/280.1 |
| 2009/0183874 | A1 | 7/2009 | Fordyce et al. | |
| 2010/0044041 | A1 * | 2/2010 | Smith | E21B 34/14 166/280.1 |
| 2014/0262292 | A1 * | 9/2014 | Joseph | E21B 43/26 166/308.1 |

OTHER PUBLICATIONS

International Preliminary Report on Patentability issued in related PCT Application No. PCT/US2013/054089 dated Feb. 18, 2016 (12 pages).

* cited by examiner

METHODS AND SYSTEMS FOR TREATMENT OF SUBTERRANEAN FORMATIONS

CROSS-REFERENCE TO RELATED APPLICATION

The present application is a U.S. National Stage Application of International Application No. PCT/US2013/054089 filed Aug. 8, 2013, which is incorporated herein by reference in its entirety for all purposes.

BACKGROUND

The present invention relates generally to performance of subterranean operations. Specifically, the present invention is directed to improved methods and systems for treating subterranean formations using a sub-surface mixing system.

Hydrocarbons such as oil and natural gas continue to remain valuable commodities. It is therefore desirable to develop methods and systems that can be used to efficiently extract hydrocarbons from a reservoir. One of the operations that may be used to enhance production from a reservoir is hydraulic fracturing where fractures are formed in the formation and propped open using a proppant to stimulate the formation. When performing hydraulic fracturing operations, a fracturing fluid may be introduced into a portion of a subterranean formation penetrated by a well bore at a hydraulic pressure sufficient to create or enhance one or more fractures therein. Such fractures may be formed for instance, when a subterranean formation is stressed or strained. Stimulation and/or treatment of the well bore in this manner may improve the efficiency of hydrocarbon production from a well bore.

One of the materials that may be used to perform hydraulic fracturing operations is Liquefied Petroleum Gas ("LPG"). Specifically, LPG may be mixed with solid particulates (proppants) such as sand (and/or other desirable materials) at the surface and then directed downhole to perform fracturing operations. For instance, in a typical fracturing operation using LPG, sand may be blended with LPG under pressures greater than 100 psig. High pressure pumps may then be used to pressurize (for instance, to pressures greater than 4000 psig) and flow the gelled LPG-slurry at rates greater than 20 bpm.

However, current methods and systems using LPG have several disadvantages. LPG is primarily comprised of propane and as such, exists in a highly combustible, gaseous form under standard atmospheric conditions. Therefore, to be used as a fracturing fluid, LPG must be mobilized through the fracturing equipment under pressure (usually a pressure between 100 psig and 500 psig). As a result, the LPG inherently has a higher operational hazard risk than conventional aqueous fracturing fluid systems. Consequently, engineering designs to prevent leaks and contingency plans to manage realized leaks are critical to the operation. Further, blending and pumping solid particulates (proppant) with LPG greatly amplifies the aforementioned operational risks and increases the engineering challenges faced in order to prevent and manage LPG leaks. It is therefore desirable to develop a method and system that can be used to safely and efficiently utilize LPG in performance of subterranean operations such as fracturing operations.

BRIEF DESCRIPTION OF THE DRAWINGS

These drawings illustrate certain aspects of some of the embodiments of the present invention, and should not be used to limit or define the invention.

Figure 1:
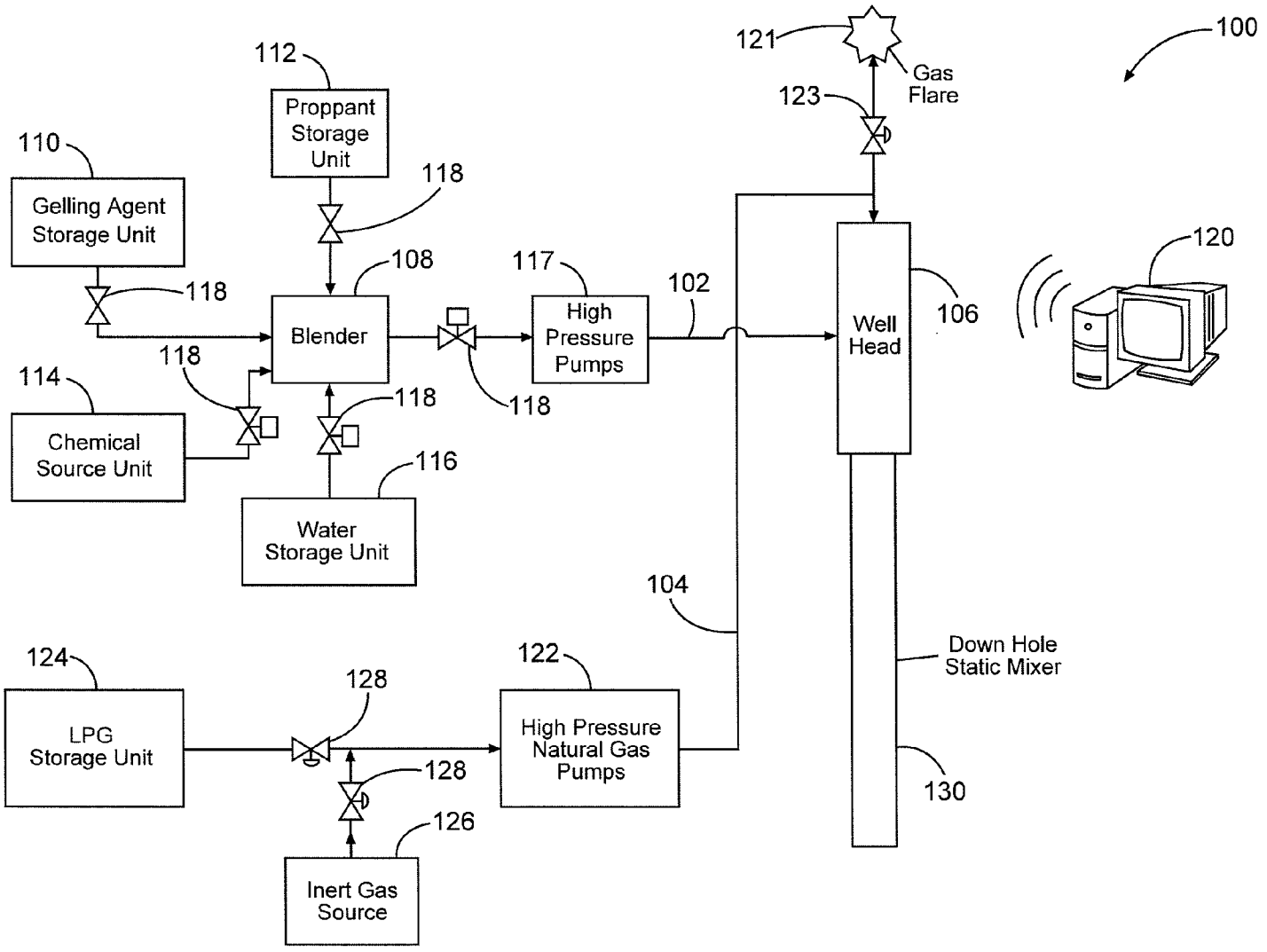
FIG. 1 depicts a system for treatment of a subterranean formation in accordance with a first illustrative embodiment of the present disclosure.

While embodiments of this disclosure have been depicted and described and are defined by reference to exemplary embodiments, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present invention relates generally to performance of subterranean operations. Specifically, the present invention is directed to improved methods and systems for fracturing subterranean formations using a sub-surface mixing system.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves; and/or any combination of the foregoing.

The terms "couple" or "couples," as used herein are intended to mean either an indirect or a direct connection. Thus, if a first device couples to a second device, that connection may be through a direct connection, or through an indirect mechanical or electrical connection via other devices and connections. Similarly, if a first device is "fluidically coupled" to a second device, fluid may flow between the first device and the second device through a direct or an indirect fluid flow path. The term "uphole" as used herein means along the drillstring or the hole from the distal end towards the surface, and "downhole" as used herein means along the drillstring or the hole from the surface towards the distal end. Further, the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface.

The present application discloses a method and system that greatly reduces environmental, operational, and safety hazards associated with typical fracturing operations using LPG. Specifically, proppant may be blended and pressurized for stimulation with a non-volatile fluid system prior to being blended with a volatile fluid system such as LPG. In certain implementations, the proppant-laden non-volatile fluid and the volatile fluid streams may be blended post-pressurization such as, for example, at pressures greater than 1000 psig.

Turning now to FIG. 1, a system for treatment of a subterranean formation in accordance with an illustrative embodiment of the present disclosure is denoted generally with reference numeral 100. The system 100 includes a first flow line 102 and a second flow line 104 that are directed downhole through a well head 106. The first flow line 102 fluidically couples a blender 108 to the well head 106 while the second flow line 104 fluidically couples a LPG storage unit 124 to the well head 106 as discussed in further detail below. The well head 106 may be a subsea well head or one that is located on land. The first flow line 102 directs a proppant laden fluid stream downhole through the well head 106. This stream is generally referred to herein as the "fluid stream."

In certain embodiments, a blender 108 is provided at the surface. The blender 108 may receive a first input from a gelling agent storage unit 110, a second input from a proppant storage unit 112, a third input from a chemical storage unit 114 and a fourth input from a water storage unit 116. The term "storage unit" as used herein is intended to include both a component which stores a material and a component which is the source of a material. Specifically, although the various components are referred to as storage units, each storage unit may in fact be a source of the particular material. For instance, the water storage unit 116 may be a water supply or water source without departing from the scope of the present disclosure.

In certain embodiments, the gelling agent stored in the gelling agent storage unit 110 may be in either a liquid or a dry powder form. The term "gelling agent" is defined herein to include any substance that is capable of increasing the viscosity of a fluid, for example, by forming a gel. The gelling agent may use diesel or another suitable liquid hydrocarbon based fluid. In certain implementations, the gelled fluid may be an acid based fluid with one or more appropriate gelling agents. Examples of commonly used polymeric gelling agents include, but are not limited to, guar gums and derivatives thereof, cellulose derivatives, biopolymers, and the like. However, any suitable gelling agents known to those of ordinary skill in the art, having the benefit of the present disclosure may be used. For example, in certain implementations, the gelling agents may be hydrocarbon gelling agents including, but not limited to, a polyvalent metal salt of an organophosphonic acid ester or a polyvalent metal salt of an organophosphinic acid. The gelling agent may be directed into the blender 108 where it may be combined with water from the water storage unit 116, proppants from the proppant storage unit 112 and chemicals from the chemical storage unit 114.

The chemicals that are combined with the gelling agent may include, but are not limited to, pH Buffers, Biocides, salts, scale inhibitors, surfactants (e.g., foaming surfactants), cross-linkers, Oxidizing breakers, enzyme breakers, clay stabilizing agents, gel stabilizers, and any other suitable chemicals known to those of ordinary skill in the art, having the benefit of the present disclosure. Similarly, a number of different materials may be used as the proppant. For instance, the proppant may include, but is not limited to, sand, ceramic, sintered bauxite, bauxite, pre-cure and curable resin coated proppant, glass beads, and other suitable materials known to those of ordinary skill in the art, having the benefit of the present disclosure. Moreover, in certain implementations, diverting agents may also be utilized. Specifically, the proppant itself may be a diverting agent or a diverting agent may be stored in one or more separate containers (not shown) and directed to the blender 108. Any suitable diverting agent may be used including, but not limited to, PLA, Rock Salt, RPMs, or Conductivity Endurance materials available from Halliburton Energy Services, Inc., of Duncan, Okla. The Conductivity Endurance materials may be proppant coatings applied to the proppant at the job site as a liquid coating just before the proppant enters the fluid stream. For instance, in certain implementations, the Conductivity Endurance materials may be SandWedge®, PropLok™, or liquid resins.

In certain implementations, the proppant may be blended into the fluid stream flowing through the first flow line 102 using conventional fracturing equipment practices, in a non-volatile hydrocarbon carrier fluid system such as, for example, crude oil, diesel, etc. In certain other implementations the proppant may be blended using conventional fracturing equipment practices, in a non-volatile aqueous carrier fluid system such as any conventional aqueous fluid systems known to those of ordinary skill in the art. Further, in some embodiments, the proppant may be blended using pressurized fracturing equipment practices (e.g., using a pressurized blender), in a non-volatile fluid system such as, for example, Carbon Dioxide, Nitrogen, a Nitrogen/Carbon Dioxide mixture and/or a Carbon Dioxide/LPG/Liquefied Natural Gas ("LNG") mixture.

One or more high pressure pumps 117 may be used to direct the fluid stream from the blender 108 (referred to herein as the "blender fluid") through the first flow line 102 to the well head 106 and into the well bore. The high pressure pumps 117 may be any suitable pumps including, but not limited to, any type of high pressure positive displacement pump suitable for oilfield applications, as well as, any staged centrifugal pumps capable of achieving the rates and pressures typical of a split stream fracturing operation. Accordingly, the fluid stream from the blender 108 may be pumped to the well head 106 and into the well bore through its own high pressure ground manifold, independent from the LPG stream.

In certain embodiments, one or more valves 118 may be used to control fluid flow into the blender 108 from the various storage units and through the first flow line 102. In certain implementations, the system 100 may be communicatively coupled to an information handling system 120 using a wired or wireless communication network. The structure and implementation of such communication networks is well known to those of ordinary skill in the art, having the benefit of the present disclosure, and will therefore not be discussed in detail herein. The information handling system 120 may control the operations of the system. For instance, the information handling system 120 may open and close the valves 118 as needed in order to achieve a desired concentration of the fluid stream that exits the blender 108 (i.e., the blender fluid). In certain embodiments, a sensor (not shown) may monitor the concentration of various components of the fluid stream that flows out of the blender 108 and through the first flow line 102. The sensor may provide feedback to the information handling system 120 which can then compare the concentration of the various components of the fluid stream to a corresponding desired value. This desired value may be input by the user and may be stored in a computer-readable medium. The information handling system 120 may then adjust the valves 118 if the concentration of any of the components of the fluid stream needs to be adjusted to achieved the desired fluid stream concentration.

The second flow line 104 which is independent of the first flow line 102 discussed above may be used to direct LPG to the well head 106. Specifically, one or more high pressure natural gas pumps 122 may be used to pump LPG from a LPG source or a LPG storage unit 124 to the well head 106. In certain implementations, an inert gas source 126 may be used to deliver an inert gas into the LPG stream as it is being pumped by the high pressure natural gas pumps 122. Any suitable inert gas may be used in the system such as, for example, Nitrogen or Carbon Dioxide. Any residue gas in the system that is not directed downhole through the well head 106 may be flared off at a gas flare 121. In certain implementations, a valve 123 may be used to regulate gas flow to the gas flare 121.

In the same manner discussed above with respect to the first flow line 102, one or more valves 128 may be used to regulate fluid flow from the LPG storage unit 124 and the inert gas source 126. Further, the information handling system 120 may be used to monitor the concentration of components flowing through the second flow line 104 and may adjust the valves 128 to maintain the desired concentration of materials in the second flow line 104 in the same manner discussed above with respect to the first flow line 102.

The LPG stream (which may also include some inert gas) flows through the second flow line 104 and may be pumped to the well head 106 and into the well bore. There may be two distinct downhole flow paths through the well head 106 into the well bore. One flow path may be through the annulus between the casing and an interior conduit such as, for example, a protective stinger that extends below the casing shut-off valve to protect the casing valve from abrasive erosion. The other flow path may be through the interior of a conduit such as, for example, a tubing, a coiled tubing, or a protective stinger. These two flow paths may be referred to as the first flow path and the second flow path. Accordingly, the fluid stream of the first flow line 102 may be directed downhole through the first downhole flow path while the LPG stream of the second flow line 104 may be directed downhole through the second downhole flow path. As a result, the two streams do not come in contact with each other until they reach a desired downhole location. Alternatively, the fluid stream of the first flow line 102 may be directed downhole through the second downhole flow path while the LPG stream of the second flow line 104 may be directed downhole through the first downhole flow path to avoid premature contact between the two streams.

Once downhole, the blender fluid from the first flow line 102 and the LPG stream from the second flow line 104 are directed to an annulus of a static mixing device 130. This static mixing device 130 may be positioned within the well bore at a sufficient depth so that it can substantially prevent any of the explosive gas and/or other hazardous chemical reactions from returning to the surface. For instance, in certain implementations, the static mixing device 130 may be located at any position in the well bore in the interval between the well head 106 and the fracturing interval. The term "fracturing interval" as used herein generally refers to the well bore interval where fracturing operations are to be performed. For instance, in certain illustrative implementations, the static mixing device 130 may be disposed at a depth of between approximately 6 feet downhole from well head 106 to approximately 6 feet uphole from the target fracturing interval.

In this manner, the system 100 may be used to greatly reduce operational hazards by blending and pressurizing proppant with a non-volatile fluid system through the first flow line 102 prior to blending the proppant with a volatile fluid system such as the LPG stream. In accordance with certain implementations, the proppant-laden non-volatile fluid of the first flow line 102 and the volatile LPG stream of the second flow line 104 maybe blended post-pressurization (i.e., greater than 1000 psig).

Figure 2:
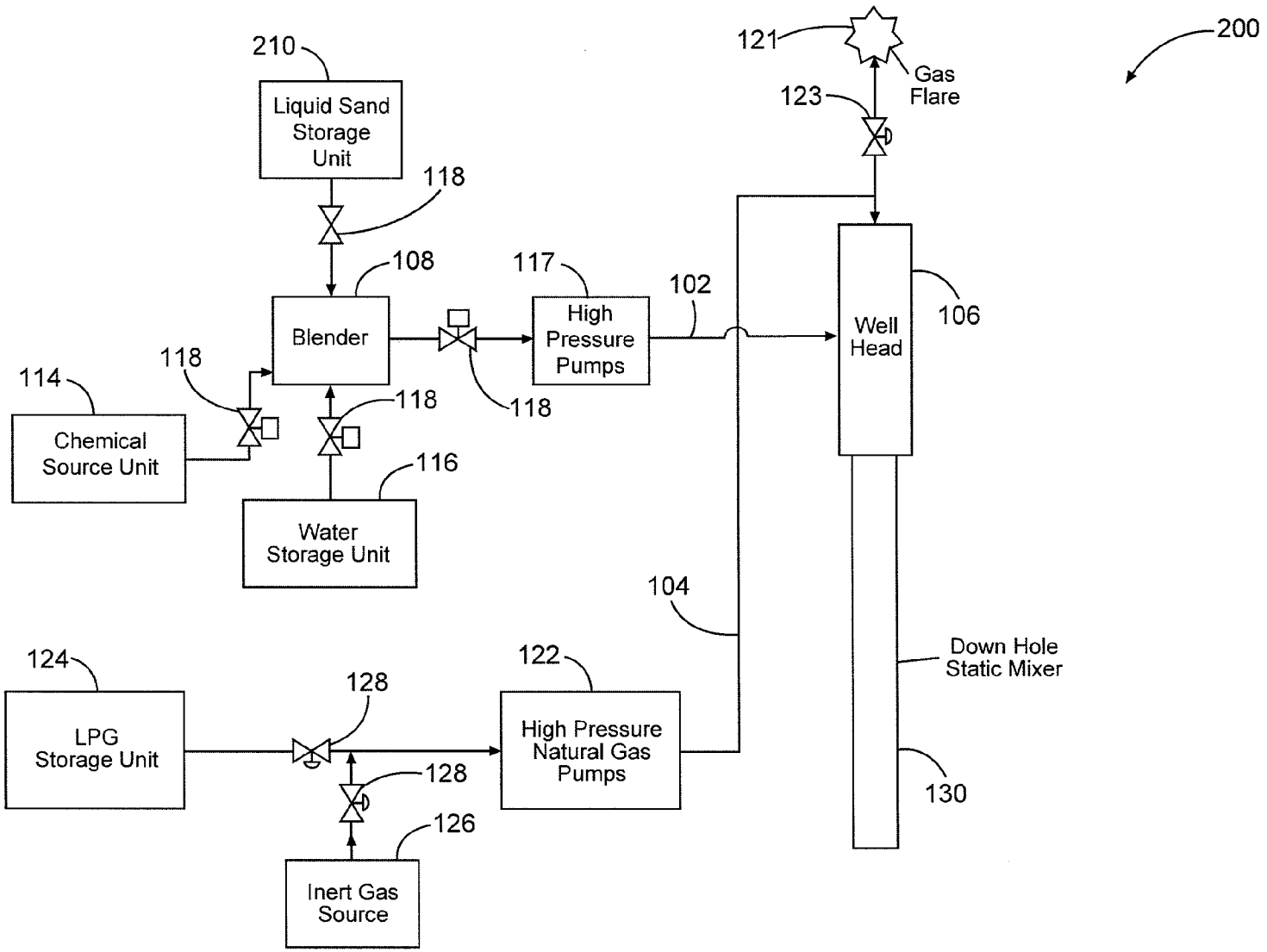
FIG. 2 depicts a system for treatment of a subterranean formation in accordance with a second illustrative embodiment of the present disclosure.

FIG. 2 depicts a system for treatment of a subterranean formation in accordance with another illustrative embodiment of the present disclosure which is denoted generally with reference numeral 200. In this embodiment, the gelling agent storage unit 110 and the proppant supply storage unit 112 of FIG. 1 are replaced with a liquid sand storage unit 210. In this embodiment, the gelling agent and the proppant are pre-mixed. The mixture of the gelling agent and the proppant is referred to herein as liquid sand. This liquid sand is stored in the liquid sand storage unit 210. The remaining components of the system 200 are the same as that of the system 100 and the two systems otherwise operate in the same manner.

Figure 3:
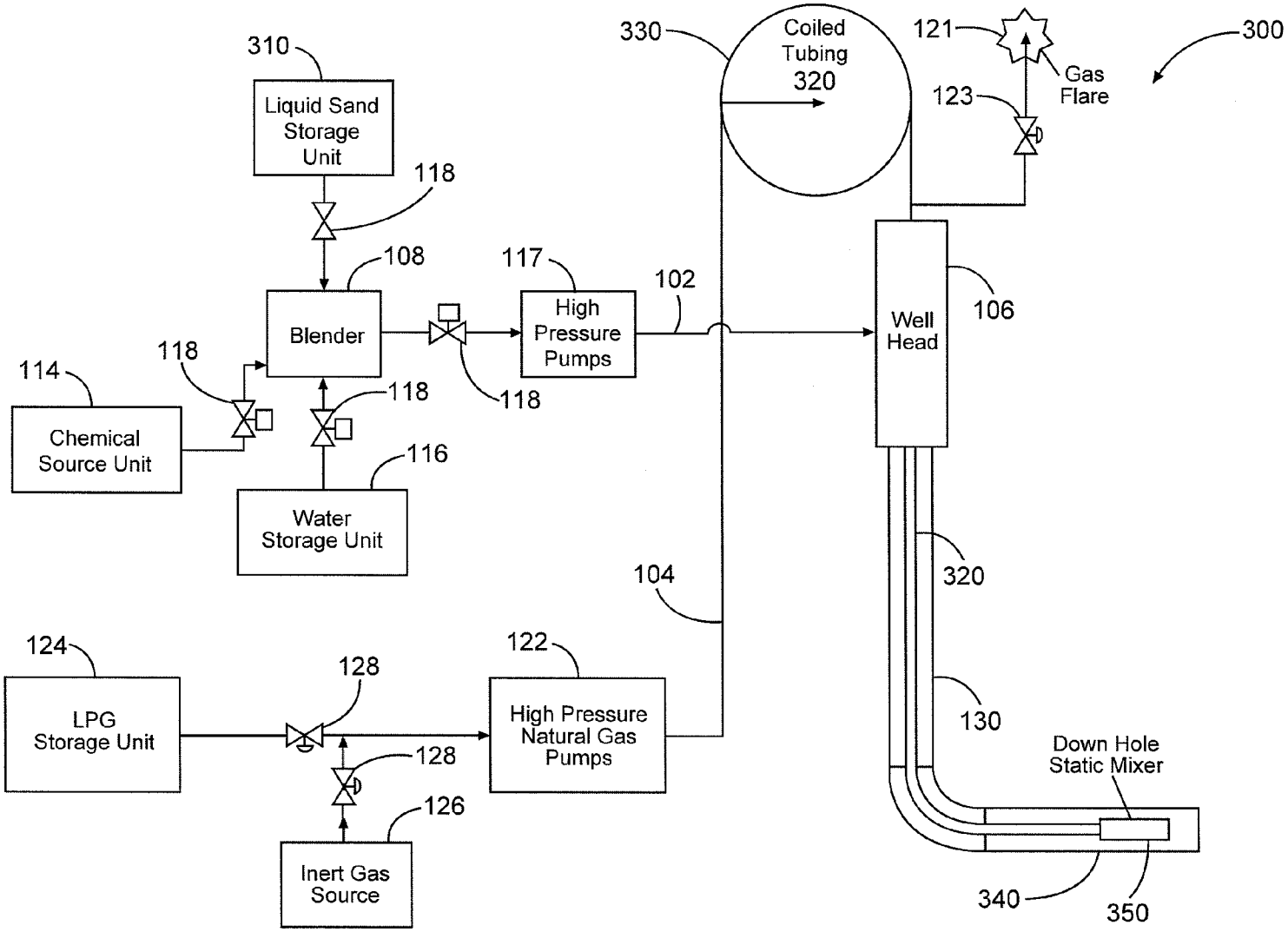
FIG. 3 depicts a system for treatment of a subterranean formation in accordance with a third illustrative embodiment of the present disclosure.

FIG. 3 depicts a system for treatment of a subterranean formation in accordance with another illustrative embodiment of the present disclosure which is denoted generally with reference numeral 300. The system 300 operates in a manner similar to the systems 100, 200 except that the LPG stream of the second flow line 104 is pumped downhole through a coiled tubing 320. The coiled tubing 320 may be positioned on a reel 330 which can be rotated to move the coiled tubing 320 into or out of the well bore.

Specifically, in this embodiment, the coiled tubing 320 directs the LPG stream from the second flow line 104 to a desired downhole location 340 which is proximate to the location where perforations are to be created. Similarly, the blender fluid that flows through the first flow line 102 passes through the well head 106 and is directed to the desired location 340. Accordingly, the LPG stream and the blender fluid are mixed in a downhole static mixer 350 at the desired downhole location 340 which is proximate to the location where perforations are to be created. The structure and operation of such downhole static mixers are well known to those of ordinary skill in the art, having the benefit of the present disclosure and will therefore not be discussed in detail herein. For example, U.S. Pat. Nos. 8,104,539; 8,061,426 and 7,841,396 which are assigned to the assignee of the present application describe the structure and operation of illustrative downhole static mixers and are incorporated by reference herein in their entirety. In certain implementations, the downhole static mixer 350 may be a perforating device such as a hydra-jet tool. The structure and operation of such a hydra-jet tool is described, for example, in U.S. Pat. Nos. 8,061,426 and 7,841,396 which are assigned to the assignee of the present application and are incorporated by reference herein in their entirety. Accordingly, in certain implementations, the downhole static mixer 350 can function as a hydra-jet perforating device to create perforations prior to performing the hydraulic fracturing operations using the mixture of the LPG stream and the fluid stream. Further, in certain implementations, the same downhole static mixer 350 may provide isolation from previously stimulated intervals or facilitate passage of balls in order to activate sliding sleeves and isolate previously stimulated intervals. The performance of such operations is well known to those of ordinary skill in the art, having the benefit of the present disclosure and is discussed, for example, in U.S. Pat. No. 7,775,285 which is assigned to the assignee of the present application and which is incorporated by reference herein in its entirety. The remaining components of the system 300 are the same as that of the systems 100, 200 and the systems otherwise operate in the same manner.

Accordingly, the present disclosure provides a method and system for treatment of subterranean formations such as for performance of fracturing operations. In order to perform fracturing operations, a stream of LPG is injected into a well bore at fracturing treatment pressures where it is combined with gelled proppant concentrate being mixed on the surface at precise ratios that when combined downhole through a static mixing device produce the exact fluid characteristics needed to fracture the formation. In certain implementations, an inert gas such as, for example, Nitrogen, may be used for purging the system components of LPG, and to help protect against risk of explosion.

Further, unlike the prior art system, the methods and systems disclosed herein provide two distinct flow paths for the fluid stream and the LPG stream, each having its own set of high pressure pumps and manifolds. In this manner, the hazardous LPG stream is maintained separate from the gelling agents, proppants, water or chemicals required to perform hydraulic fracturing operations. Further, because the two streams are separated, the gelling agents, proppants, water and/or chemicals can be handled without concern for potential hazards and risks associated with handling the LPG stream. Moreover, the system foot print may be further minimized by eliminating the distinct components associated with the proppants and the gelling agents and replacing them with liquid sand.

Accordingly, the methods and systems disclosed herein facilitate a safe and environmentally friendly approach for utilizing LPG to stimulate a subterranean formation. This is important as the use of LPG to stimulate a subterranean formation has several advantages. First, LPG is readily available. Moreover, under the pressures and temperatures consistent with hydraulic fracturing operations, LPG may be gelled to provide appreciable viscosities and viscoelastic properties. As a result, LPG can achieve the rheology performance of conventional aqueous fracturing fluids, critical to proppant transport into hydraulically-created fractures in the reservoir. Further, LPG is miscible with the desired fluids in the reservoir, increasing the potential extraction rates and ultimate extraction of desired fluids from the reservoir. Additionally, under the pressures and temperatures consistent with initiating production of a well bore after stimulation, LPG may change states where the density and viscosity of the fluid decreases substantially, far more than conventional aqueous fluid systems, maximizing the propped fracture conductivity potential and ultimately reservoir production performance. Finally, when the well bore is turned to production shortly after stimulation, the LPG stimulation fluid flow back can be transported to the same processing facilities as the desired formation fluids rather than having to be collected for disposal (like conventional aqueous fluid systems). These and other advantages of using LPG to stimulate a subterranean formation highlight the importance of the methods and systems disclosed herein which reduce the risks typically associated with using LPG.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A system for treatment of a subterranean formation comprising:

a well head;

a first flow line, wherein the first flow line directs a blender fluid from a blender to the well head;

a second flow line, wherein the second flow line directs a Liquefied Petroleum Gas stream to the well head; and a static mixer comprising a perforating device positioned downhole and fluidically coupled to the well head, wherein the well head directs the blender fluid from the well head to the static mixer through a first flow path, wherein the well head directs the Liquefied Petroleum Gas stream from the well head to the static mixer through a second flow path, and wherein the static mixer mixes the blender fluid and the Liquefied Petroleum Gas stream.

2. The system of claim 1, wherein the blender receives a first input from a proppant storage unit, a second input from a gelling agent storage unit, a third input from a chemical storage unit and a fourth input from a water storage unit.

3. The system of claim 1, further comprising one or more valves regulating fluid flow in at least one of the first flow line and the second flow line.

4. The system of claim 1, wherein a high pressure pump pumps at least one of the blender fluid and the Liquefied Petroleum Gas stream downhole.

5. The system of claim 1, wherein the blender receives a first input from a liquid sand storage unit, a second input from a chemical storage unit and a third input from a water storage unit.

6. The system of claim 1, wherein the second flow path comprises a coiled tubing.

7. The system of claim 1, wherein the perforating device is a hydra-jet tool.

8. The system of claim 1, wherein the static mixer is located in an interval between the well head and a downhole fracturing interval.

9. A method of treating a subterranean formation comprising:

directing a blender fluid to a well head through a first flow line;

directing a Liquefied Petroleum Gas stream to the well head through a second flow line;

fluidically coupling a static mixer comprising a perforating device to the well head;

wherein the static mixer is disposed downhole, directing the blender fluid from the well head to the static mixer through a first flow path, directing the Liquefied Petroleum Gas stream from the well head to the static mixer through a second flow path, and mixing the blender fluid and the Liquefied Petroleum Gas stream in the static mixer.

10. The method of claim 9, further comprising:

directing a first input from a proppant storage unit to the blender;

directing a second input from a gelling agent storage unit to the blender;

directing a third input from a chemical storage unit to the blender; and directing a fourth input from a water storage unit to the blender.

11. The method of claim 9, further comprising regulating fluid flow in at least one of the first flow line and the second flow line using one or more valves.

12. The method of claim 9, further comprising pumping at least one of the blender fluid and the Liquefied Petroleum Gas stream downhole using a high pressure pump.

13. The method of claim 9, further comprising directing a first input to the blender from a liquid sand storage unit, directing a second input to the blender from a chemical storage unit and directing a third input to the blender from a water storage unit.

14. The method of claim 9, wherein the second flow path comprises a coiled tubing.

15. The method of claim 9, wherein the perforating device is a hydra-jet tool.

16. The method of claim 9, further comprising placing the static mixer in an interval between the well head and a downhole fracturing interval.

17. A method of treating a subterranean formation comprising:

directing a blender fluid to a static mixer comprising a perforating device disposed downhole, wherein the blender fluid is directed through a first flow line from a blender to a well head and the blender fluid is directed through a first flow path from the well head to the static mixer;

directing a Liquefied Petroleum Gas stream to the static mixer, wherein the Liquefied Petroleum Gas stream is directed to the well head through a second flow line and the Liquefied Petroleum Gas stream is directed from the well head to the static mixer through a second flow path; and mixing the blender fluid and the Liquefied Petroleum Gas stream in the static mixer.

18. The method of claim 17, further comprising placing the static mixer at a depth of between approximately 6 feet downhole from the well head to approximately 6 feet uphole from a fracturing interval.

* * * * *